US006328927B1

(12) United States Patent
Lo et al.

(10) Patent No.: US 6,328,927 B1
(45) Date of Patent: Dec. 11, 2001

(54) METHOD OF MAKING HIGH-DENSITY, HIGH-PURITY TUNGSTEN SPUTTER TARGETS

(75) Inventors: Chi-Fung Lo, Fort Lee, NJ (US); Paul S. Gilman, Suffern; Darryl Draper, Congers, both of NY (US)

(73) Assignee: Praxair Technology, Inc., North Haven, CT (US)

( * ) Notice: Subject to any disclaimer, the term of this patent is extended or adjusted under 35 U.S.C. 154(b) by 0 days.

(21) Appl. No.: 09/220,906

(22) Filed: Dec. 24, 1998

(51) Int. Cl.[7] ..... B22F 3/14
(52) U.S. Cl. ..... 419/45; 419/49
(58) Field of Search ..... 75/248; 419/26, 419/28, 49, 45

(56) References Cited

U.S. PATENT DOCUMENTS 1,315,859 * 9/1919 Pfanstiehl .
3,116,146 * 12/1963 Gatti .
3,303,559 * 2/1967 Holtzclaw .
4,612,162 * 9/1986 Morgan et al. ..... 419/28
4,838,935 * 6/1989 Dunlop et al. ..... 75/230
5,074,907 * 12/1991 Amato et al. ..... 75/235
5,470,527 * 11/1995 Yamanobe et al. ..... 419/53
5,807,443 * 9/1998 Masuda et al. ..... 148/535

FOREIGN PATENT DOCUMENTS 62-182202 * 8/1987 (JP) .

OTHER PUBLICATIONS

ASM Handbook, vol. 7, Powder Metallurgy, pp. 428–429, 1984.*

* cited by examiner

*Primary Examiner*—Daniel J. Jenkins
(74) *Attorney, Agent, or Firm*—Blake T. Beiderman

(57) ABSTRACT

A method is provided for fabricating tungsten sputter targets having a density of at least about 97% of theoretical density and an oxygen content of at least about 100 ppm less than the starting powder. According to the principles of the present invention, a tungsten powder having a powder size less than about 50 $\mu$m and an oxygen content less than about 500 ppm is hot-isostatic pressed at a temperature of about 1200° C. to about 1600° C. and a pressure of at least about 15 ksi for at least about 3 hours. A high-purity sputter target is further achieved by using a tungsten starting powder having a purity higher than about 99.999%.

13 Claims, No Drawings

METHOD OF MAKING HIGH-DENSITY, HIGH-PURITY TUNGSTEN SPUTTER TARGETS

FIELD OF THE INVENTION

This invention relates to the fabrication of high-purity, high-density tungsten sputter targets for use in physical vapor deposition of thin films.

BACKGROUND OF THE INVENTION

In the manufacture of sputter targets used in the semiconductor industry, and more particularly to sputter targets used in physical vapor deposition (PVD) of thin films onto complex integrated circuits, it is desirable to produce a sputter target that will provide film uniformity, minimal particle generation during sputtering, and desired electrical properties. Furthermore, to meet the reliability requirements for diffusion barriers or plugs of complex integrated circuits, the sputter target must have high-purity and high-density.

Current methods to achieve suitable sputter targets for use in complex integrated circuits involve either hot-pressing or cold-isostatic-pressing followed by high temperature sintering. Using either of these techniques, the density of the pressed target material is about 90% of theoretical density. To obtain that 90% density, the sintering process needs to proceed at a minimum of 1800° C. This high temperature results in a significant growth of the grains. Large grain size in sputter targets is deleterious to the uniformity of the deposited films. Furthermore, the sputter targets fabricated by these methods have a high oxygen content, which results in a high film electric resistivity. In addition, these processes typically involve pressing in a graphite die mold. Some volatile contaminations are contributed to the targets by this graphite mold, which results in an increase in the impurities in the films and deteriorates the reliability of the sputter devices. For example, graphite has a high alkaline element which evaporates out of the mold and is absorbed by the sputter target during pressing and sintering. Thus, the sputter targets fabricated by the hot-press or cold-isostatic-press followed by high temperature sintering have proved unreliable for use in complex integrated circuits.

There is thus a need to develop a method for fabricating high-purity, high-density tungsten sputtering targets that will meet the reliability requirements for complex integrated circuits.

SUMMARY OF THE INVENTION

The present invention provides a tungsten sputter target having a density of at least about 97% of theoretical density and an oxygen content of at least about 100 ppm less than the starting powder. Furthermore, this high-density, low oxygen sputter target may be produced with a metallic purity of at least about 99.9995. This high-density, high-purity tungsten sputter target is fabricated by (a) providing a tungsten powder having a purity higher than about 99.999%, a powder size smaller than about 50 $\mu$m and preferably smaller than about 20 $\mu$m, and an oxygen content less than about 500 ppm; and (b) hot-isostatic-pressing the powder at a temperature between about 1200° C. to about 1600° C. at a pressure of at least about 15 ksi for at least about 3 hours. In a preferred embodiment of the invention, the tungsten powder has a purity of at least 99.9995%, a powder size of less than about 10 $\mu$m, and an oxygen content less than about 300 ppm.

In a further preferred embodiment of the present invention, hot-isostatic-pressing is performed at a temperature of about 1400° C. and a pressure of about 40 ksi for about 7 hours. Where a desired target diameter to height ratio is greater than about 3, the method of fabricating the sputter target preferably includes the additional step of cold-isostatic pressing the powder prior to hot-isostatic-pressing.

In a preferred embodiment of the invention, the powder is pressed in a powder capsule made of either titanium, iron, or an alloy thereof, to reduce the oxygen level of the tungsten.

These and other objects and advantages of the present invention shall become more apparent from the accompanying description thereof.

DETAILED DESCRIPTION

According to the principles of the present invention, a tungsten sputter target is fabricated having an oxygen content of at least about 100 ppm less than the starting powder and a density higher than 97% of theoretical density. By starting with a high purity powder, such as 99.999% purity or higher tungsten powder, a high-purity sputter target may also be achieved. This high-purity, high-density tungsten sputter target can be used in the physical vapor deposition of thin films as diffusion barriers or plugs in complex integrated circuits.

To achieve the high-density tungsten sputter target, a tungsten powder is provided having a powder size smaller than about 50 $\mu$m. To obtain a high-purity tungsten sputter target, the tungsten powder is further provided with an oxygen content less than about 500 ppm (such as that commercially available from Sumitomo, Tokyo, Japan). In a preferred embodiment of the present invention, the tungsten powder is provided with a powder size smaller than about 20 $\mu$m, and more preferably smaller than about 10 $\mu$m, and an oxygen content less than about 300 ppm. This tungsten powder is then hot-isostatic-pressed at a temperature in the range of 1200° C. to 1600° C. at a pressure higher than about 15 ksi for a period of at least 3 hours in an inert environment such as argon. The temperature of the hot-isostatic-press (HIP) is preferably about 1400° C. with a pressure of about 40 ksi. At these preferred temperature and pressures, the hot-isostatic-pressing (HIPing) step is preferably performed for about 7 hours.

The HIPing method requires the use of a capsule for containing the powder material during pressing. The capsule material must be capable of substantial deformation because the HIPing method uses high pressure to achieve about a 50–70% volume reduction. Furthermore, the capsule material must have a melting point higher than the HIPing temperature. Thus, any material of sufficiently high melting point that can withstand the degree of deformation caused by the HIPing process is suitable for the present invention. Suitable materials may include, for example, beryllium, cobalt, copper, iron, molybdenum, nickel, titanium or steel.

A cold-isostatic-pressing step prior to the HIPing step is recommended for target diameter/height ratios of greater than about 3. This consolidated powder can then be machined using known techniques, such as electro-discharge machining, water-jet cutting or a regular mechanical lathe. Once machined, the consolidated target blank can be bonded to a backing plate using known methods, such as soldering with a lead-tin or indium/tin solder.

The sputter targets fabricated by this process have a density higher than 97% of theoretical density, and normally, a 99% density can be achieved through the use of the smaller particle size starting powder. Thus, the combination of the HIPing process with a small particle size starting powder produces a highly dense tungsten sputter target. This high-density reduces particle generation from the targets during sputtering.

High-purity sputter targets may also be produced by using a starting powder of high purity. For example, a starting powder having a metallic purity higher than about 99.999% consolidated by HIPing can produce a sputter target having a metallic purity of at least about 99.9995.

The oxygen level of the targets produced by the present invention is at least about 100 parts per million less than the starting powder. This can further be achieved by using a powder capsule made of such materials as titanium, iron or alloys thereof. It is believed that because oxygen in the powder material, such as in the form of $WO_2$, is not stable at the high temperatures used in the HIPing process, the capsule material will react with the oxygen. Thus, it is believed that these powder capsules can act as an oxygen absorber to reduce the oxygen level of the tungsten by more than 100 ppm. The lower oxygen content in the sputter targets of the present invention results in a decrease in the resistivity in conducting films. Thus, any material that reacts with unstable oxygen and meets the melting point and deformation requirements discussed above is a suitable material for use in the present invention. Morever, less alkaline contaminations are picked up during the consolidation process of the present invention by the elimination of graphite molds. The powder capsules of the present invention, such as Ti or Fe capsules, contain very low alkaline content, which will not escape or evaporate from the capsule during HIPing. Reducing alkaline elements in the films reduces leakage of the gate insulation in the integrated circuit, which results in improved reliability of the devices. Furthermore, the hot-isostatic-pressing used in the method of the present invention uses lower temperatures and higher pressure than previous methods, which avoids grain growth of the target material. Fine grains in a sputtering target will improve the uniformity of the deposited film.

EXAMPLES

Two tests (Test Nos. 1 and 2) for comparative purposes were run using the hot-pressing technique currently used. Two tungsten powders having two different contents of elemental impurities, were hot-pressed in a graphite mold at 1800° C. at a pressure of 1 ksi for a period of 10 hours. Two tests (Test Nos. 3 and 4) were conducted using the fabrication technique of the present invention. Two tungsten powders having two different contents of elemental impurities were hot-isostatic-pressed in a Ti capsule at a temperature of 1400° C. and a pressure of 20 ksi for a period of 7 hours. A comparison of the volatile impurity elements, oxygen content and density for the two comparative tests, 1 and 2, and the tests using the technique of the present invention, tests 3 and 4, are provided in Table 1.

TABLE 1

| Test No. | Test Conditions | Starting Powder or Pressed Target | Content of Impurity Elements (ppm) Al | K | Na | O | Density (%) of target |
|---|---|---|---|---|---|---|---|
| 1 | hot-pressed @ 1800° C./1 ksi/10 h | powder | 0.48 | 0.042 | 0.033 | 256 | 89 |
| | | target | 3.60 | 0.200 | 0.200 | 258 | |
| 2 | hot-pressed @ 1800° C./1 ksi/10 h | powder | 5.00 | 0.048 | 0.044 | 200 | 90 |
| | | target | 10.00 | 0.105 | 0.270 | 239 | |
| 3 | hot-isostatic-pressed @ 1400° C./20 ksi/7 h | powder | 0.325 | 0.040 | 0.022 | 334 | 99 |
| | | target | 0.070 | 0.086 | 0.082 | 232 | |
| 4 | hot-isostatic-pressed @ 1400° C./20 ksi/7 h | powder | 0.500 | 0.040 | 0.030 | 217 | 98 |
| | | target | 0.027 | 0.085 | 0.110 | 80 | |

The table demonstrates that prior art hot-pressing technique using a graphite mold produces a sputter target having an oxygen content approximately equal to or higher than the oxygen content of the starting powder. For the sputter targets produced by the hot-isostatic-pressing method the present invention using a Ti capsule, oxygen content in the sputtering target was decreased by at least 100 ppm from the value of the starting powder. The table also demonstrates that the content of certain volatile elements is lower in the sputter targets produced by hot-isostatic-pressing of the present invention as compared to the contents of those volatile elements produced by hot-pressing. For aluminum, the content in the sputtering target was drastically higher than the aluminum content of the starting powder when hot-pressing was performed. In contrast, the aluminum content of the sputtering target was lower than the content of aluminum in the starting powder when hot-isostatic-pressing was performed. The presence of potassium and sodium was found to increase in the sputter target in all four tests, but the increase was significantly higher in the case of hot-pressing. Hot-isostatic-pressing produced only a small increase in sodium and potassium content.

The density of the sputter target produced by hot-pressing, as shown in tests 1 and 2, was only 89% and 90% of theoretical density, respectively. For tests 3 and 4, which were fabricated using the hot-isostatic-pressing method of the present invention, 98–99% densities were achieved. Thus, Table 1 shows that fabrication of tungsten sputtering targets by the method of the present invention using hot-isostatic-pressing is capable of producing high-purity, high-density targets having a significant reduction in oxygen content.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, although titanium or iron powder capsules were described, it is contemplated that any material that acts as an oxygen absorber and that meets the melting point and deformation requirements described herein will be useful in the method of the present invention. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A method of fabricating high-density tungsten sputter targets, comprising the steps of:

hot-isostatic-pressing a tungsten powder at a temperature between about 1200° C. and about 1600° C. and a pressure of at least about 15 ksi for at least about 3 hours in a titanium capsule to form a blank, the powder having a powder size smaller than about 50 μm and an oxygen content less than about 500 ppm; and removing at least 100 ppm of the oxygen from the powder with the titanium capsule during the hot-isostatic-pressing of the powder to increase density of the blank to at least about 97 percent.

2. The method of claim 1, wherein the powder has a purity of at least about 99.999%.

3. The method of claim 1, wherein the powder has a powder size of less than about 20 μm.

4. The method of claim 3, wherein the powder has a powder size of less than about 10 μm.

5. The method of claim 1, wherein the powder has an oxygen content less than about 300 ppm.

6. The method of claim 1, wherein the powder is hot-isostatic pressed at a temperature of about 1400° C. and a pressure of about 40 ksi for about 7 hours.

7. The method of claim 1, further comprising the step of cold-isostatic-pressing prior to hot-isostatic-pressing, where the desired target diameter to height ratio is greater than about 3.

8. A method of fabricating high-purity, high density tungsten sputter targets, comprising the steps of:

providing a tungsten powder having a powder size smaller than about 50 μm, an oxygen content less than about 500 ppm, and a purity higher than about 99.999%;

loading the powder into a titanium powder capsule;

hot-isostatic-pressing the powder in the powder capsule at a temperature between about 1200° C. and 1600° C. and a pressure of at least about 15 ksi for at least about 3 hours to form a blank; and removing at least 100 ppm of the oxygen from the powder with the titanium capsule during the hot-isostatic-pressing of the powder to increase density of the blank to at least about 97 percent.

9. The method of claim 8, wherein the powder has a powder size of less than about 20 μm.

10. The method of claim 9, wherein the powder has a powder size of less than about 10 μm.

11. The method of claim 8, wherein the powder has an oxygen content less than about 300 ppm.

12. The method of claim 8, wherein the powder is hot-isostatic pressed at a temperature of about 1400° C. and a pressure of about 40 ksi for about 7 hours.

13. The method of claim 8, further comprising the step of cold-isostatic-pressing prior to hot-isostatic-pressing, where the desired target diameter to height ratio is greater than about 3.

* * * * *